US008240714B2

(12) United States Patent
Lopez

(10) Patent No.: US 8,240,714 B2
(45) Date of Patent: Aug. 14, 2012

(54) SKATEBOARD WITH SAIL ASSEMBLY

(76) Inventor: Jose A. Lopez, Miami, FL (US)

( * ) Notice: Subject to any disclaimer, the term of this patent is extended or adjusted under 35 U.S.C. 154(b) by 476 days.

(21) Appl. No.: 12/541,258

(22) Filed: Aug. 14, 2009

(65) Prior Publication Data

US 2011/0037244 A1 Feb. 17, 2011

(51) Int. Cl.
*A63C 17/12* (2006.01)
*B62B 15/00* (2006.01)

(52) U.S. Cl. ..... 280/810; 280/213

(58) Field of Classification Search ..... 280/213, 280/809, 810; 114/90, 91
See application file for complete search history.

(56) References Cited

U.S. PATENT DOCUMENTS 675,106 A * 5/1901 Oberle ..... 248/49
2,878,047 A * 3/1959 Booth ..... 403/130
2,879,568 A * 3/1959 Killen ..... 24/67.5
3,982,766 A * 9/1976 Budge ..... 280/1
4,094,262 A * 6/1978 Riedel ..... 114/43
4,498,410 A * 2/1985 Budge ..... 114/91
4,738,460 A * 4/1988 Alexander ..... 280/213
4,756,555 A * 7/1988 Bachmann ..... 280/810
5,924,732 A * 7/1999 Olsen ..... 280/810
6,142,698 A * 11/2000 Nutter ..... 403/109.1

* cited by examiner

*Primary Examiner* — Hau Phan
*Assistant Examiner* — Bryan Evans
(74) *Attorney, Agent, or Firm* — Albert Bordas, P.A.

(57) ABSTRACT

A skateboard with sail assembly, comprising a skateboard having first and second ends and a through hole. The through hole is positioned in between the first and second ends. A removable post assembly projects from the through hole. A pedal clamp assembly is mounted onto the removable post assembly. A handle bar assembly is also mounted onto the removable post assembly. The skateboard with sail assembly may be utilized with its sail in a deployed configuration or a retracted configuration. In addition, the post assembly may be completely removed so that the skateboard may be utilized on its own.

18 Claims, 6 Drawing Sheets

SKATEBOARD WITH SAIL ASSEMBLY

BACKGROUND OF THE INVENTION

1. Field of the Invention

The present invention relates to skateboards, and more particularly, to skateboards having a deployable sail.

2. Description of the Related Art

Skateboards are moveable devices that basically comprise a board having free rotating wheels that are mounted onto axles that are positioned beneath the board. Generally, movements and forces produced by a skateboarder and surface characteristics propel the skateboard. In the past, there have been several designs related to skateboards, none however suggest the novel features of the present invention.

SUMMARY OF THE INVENTION

The instant invention is a skateboard with sail assembly, comprising a skateboard having first and second ends and a through hole. The through hole is positioned in between the first and second ends. A removable post assembly projects from the through hole. A pedal clamp assembly is mounted onto the removable post assembly. The instant invention also comprises a handle bar assembly that is also mounted onto the removable post assembly, and a sail assembly.

The removable post assembly comprises third and fourth ends. The third end defines a partial sphere. The removable post assembly comprises an interior post, an exterior post, and a locking nut defining telescopic means to adjust height of the removable post assembly. The exterior post has exterior threading for the locking nut to tighten onto. The removable post assembly further comprises a semi-spherical housing to receive the partial sphere, and a locking mount that locks upon the semi-spherical housing to secure the partial sphere. The semi-spherical housing is self-lubricating. The partial sphere freely moves and swivels within the semi-spherical housing when in an unlocked configuration. The partial sphere and the locking mount each comprise a hole that receive a securing pin when aligned to place the partial sphere in a locked configuration to prevent it from freely moving and swiveling within the semi-spherical housing.

The removable post assembly further comprises first and second through holes to receive a hinge pin and fixed pin respectively to mount the pedal clamp assembly. The pedal clamp assembly comprises a pedal and at least one C-clamp. The handle bar assembly comprises a sail housing that houses the sail assembly. The sail assembly comprises a sail having at least one through hole that engages with the at least one C-clamp when the sail is deployed.

The handle bar assembly further comprises a locking assembly. The locking assembly comprises an elongated shaft having an elongated internally mounted spring therein that is fixed at one end. The spring and the elongated shaft are housed within the sail housing. The spring has a spring force to bias the sail to wrap around the elongated shaft and within the sail housing. The locking assembly further comprises a locking tab and spool that engage the elongated shaft. The sail has a proximal edge that extends from the elongated shaft. The sail has a distal edge having an elongated reinforcement. The sail housing comprises an elongated aperture to allow the sail to deploy therefrom.

It is therefore one of the main objects of the present invention to provide a skateboard with sail assembly that may be propelled by wind force.

It is another object of this invention to provide a skateboard with sail assembly that allows a user to direct and control its movements and direction.

It is another object of this invention to provide a skateboard with sail assembly that can be used with its sail deployed or stored within a sail housing.

It is another object of this invention to provide a skateboard with sail assembly that is volumetrically efficient for carrying, transporting, and storage.

It is another object of this invention to provide a skateboard with sail assembly that can be readily assembled and disassembled without the need of any special tools.

It is another object of this invention to provide a skateboard with sail assembly that is of a durable and reliable construction.

It is yet another object of this invention to provide such an apparatus that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
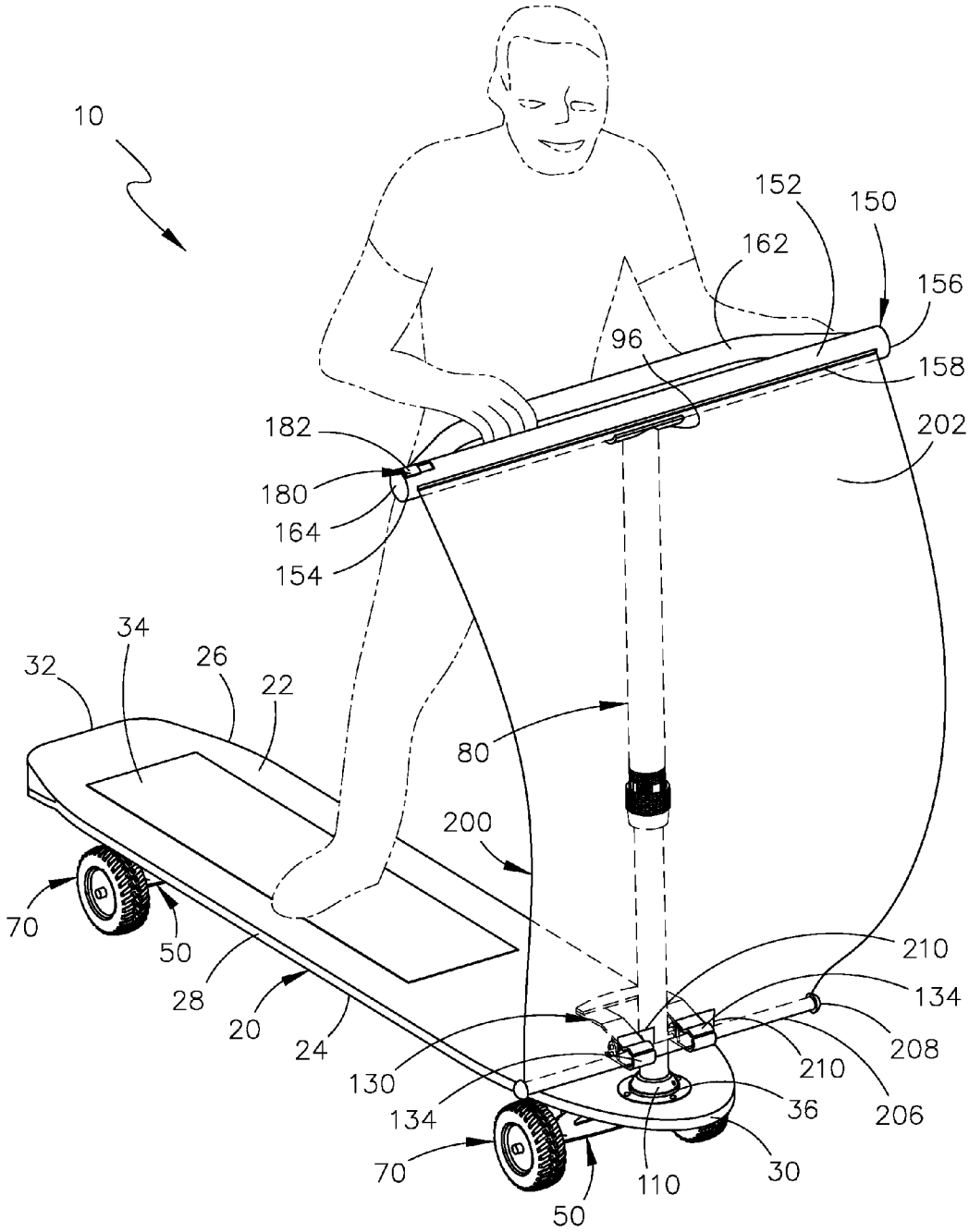
FIG. 1 is an isometric view of the present invention in use with its sail in a deployed configuration.

Referring now to the drawings, the present invention is generally referred to with numeral 10. It can be observed that it basically includes skateboard 20, removable post assembly 80, pedal clamp assembly 130, handle bar assembly 150, locking assembly 180, and sail assembly 200.

As seen in FIG. 1, skateboard 20 has a substantially oblong shape and comprises top face 22, deck 24, lateral edges 26 and 28, front end 30, and rear end 32 having a shaped brake or braking device. Grip tape 34, fixed on top face 22, prevents a user from slipping. In a preferred embodiment, through hole 36 is equidistant from lateral edges 26 and 28 and at a first predetermined distance from front end 30.

Figure 2:
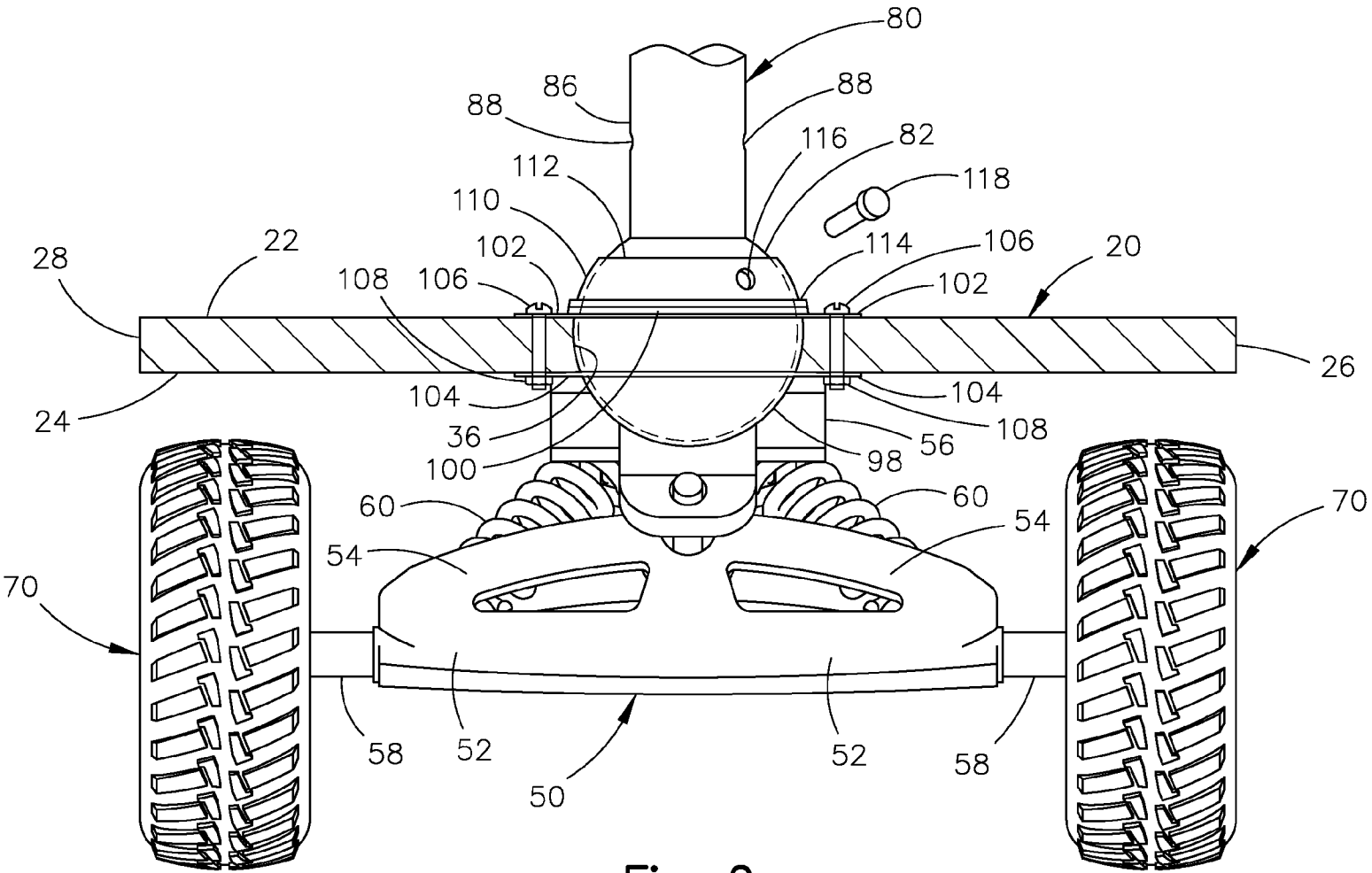
FIG. 2 is a front elevational view of a wheel and track assembly. The skateboard has been cross-sectioned to show how the partial sphere, semi-spherical housing, and locking mount secure onto the skateboard.

As seen in FIG. 2, each track assembly 50 may comprise hanger 52, hanger arms 54, joint 56, axles 58 and shock absorbers 60. Axles 58, mounted to hanger 52, support wheel assemblies 70. In one embodiment, a first joint 56 may be fixed to deck 24 at a second predetermined distance from front end 30 without reaching rear end 32, and a second joint 56, not seen, may be fixed to deck 24 at a third predetermined distance from first joint 56 without reaching rear end 32.

Figure 3:
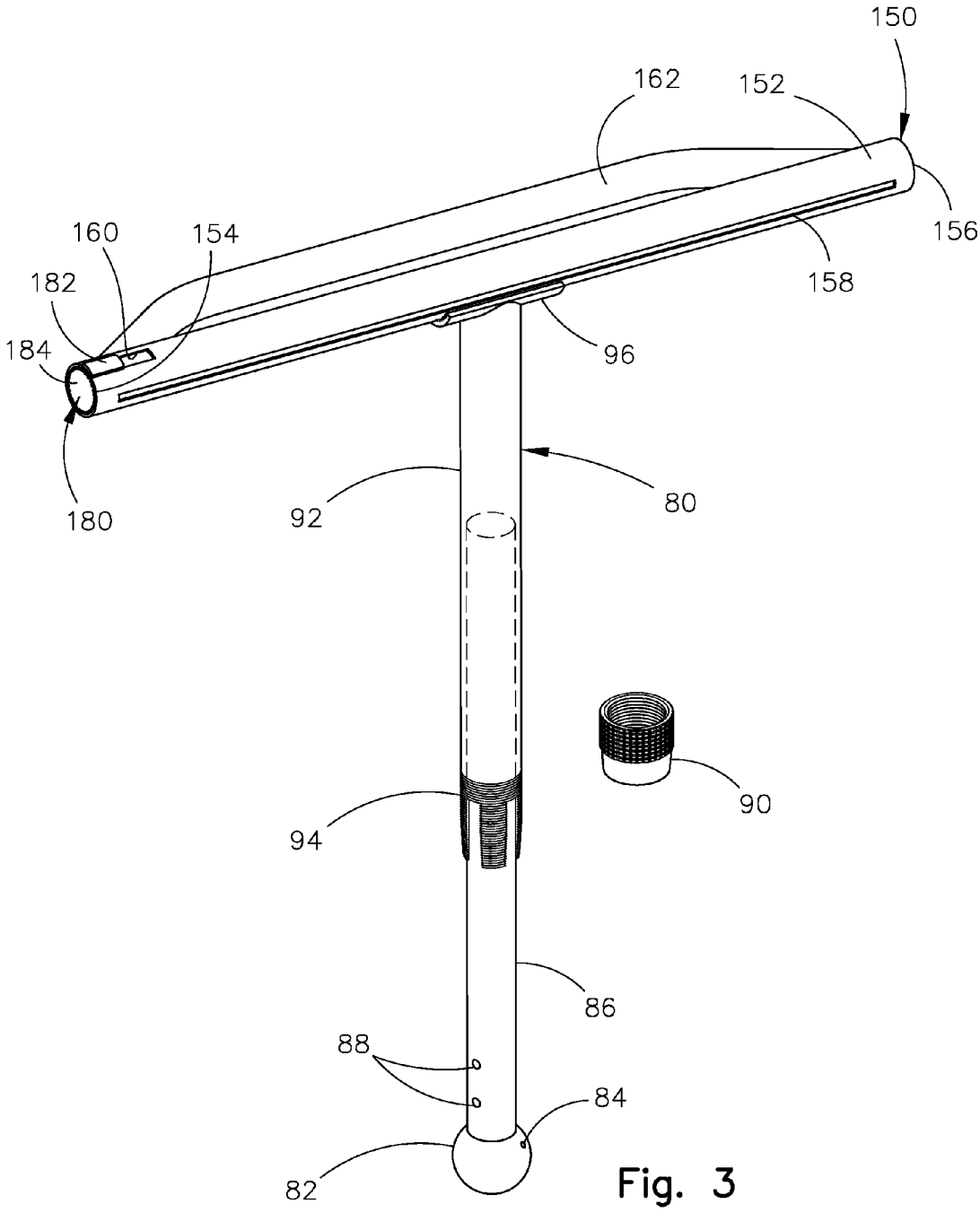
FIG. 3 is an isometric view of the post and handle bar assemblies.

As seen in FIGS. 2 and 3, removable post assembly 80 projects from through hole 36, comprising interior post 86 having partial sphere 82, and exterior post 92. Interior post 86 comprises holes 88, which in a preferred embodiment, are disposed at a parallel and spaced apart relationship from each other. Partial sphere 82 has hole 84. Exterior post 92 has exterior threading 94. Locking nut 90 has internal threading and cooperatively mounts and tightens onto exterior threading 94, thus locking the position of telescopically adjusted interior post 86 and exterior post 92. Thus, interior post 86, exterior post 92, and locking nut 90 define telescopic means to adjust height of removable post assembly 80. Exterior post 92 also has mounting plate 96, which mounts onto handle bar assembly 150. In the preferred embodiment, mounting plate 96 is welded onto handle bar assembly 150.

As best seen in FIG. 2, semi spherical housing 98 is mounted within through hole 36 with upper and lower securing plates 102 and 104 respectively. Screws 106 pass through upper securing plate 102, skateboard 20, and lower securing plate 104. Each nut 108 is mounted onto its respective screw 106, thus securing semi spherical housing 98 to skateboard 20. Semi-spherical housing is self-lubricating, meaning that it may contain a self-lubricating internal lining or coating such as one made of "TEFLON" as an example. Semi spherical housing 98 also comprises coupling section 100. Semi spherical housing 98 is of a substantially semispherical shape, with cooperative dimensions to receive partial sphere 82 therein.

Locking mount 110 has upper aperture 112. In a preferred embodiment, upper aperture 112 is of a diameter larger than an outside diameter of interior post 86, but is of a smaller diameter than that of partial sphere 82. Locking mount 110 comprises coupling section 114 having a cooperative shape and dimension to mount and lock onto coupling section 100. Therefore, locking mount 110 locks upon semi-spherical housing 98 to secure said partial sphere 82. Locking mount 110 comprises hole 116. Hole 116 may align with hole 84 of partial sphere 82. Securing pin 118 passes through holes 116 and 84, thus preventing any movement of partial sphere 82 within semi spherical housing 98 and locking mount 110 when desired. More specifically, partial sphere 82 freely moves and swivels within semi-spherical housing 98 when in an unlocked configuration. However, partial sphere 82 and locking mount 110 comprise holes 84 and 116 respectively that receive securing pin 118 when aligned to place partial sphere 82 in a locked configuration to prevent it from freely moving and swiveling within semi spherical housing 98 and locking mount 110.

As seen in FIG. 3, handle bar assembly 150 is mounted onto mounting plate 96. Handle bar assembly 150 comprises handle bar 162, and sail housing 152 that houses sail assembly 200. Sail housing 152 has ends 154 and 156, and elongated aperture 158 longitudinally extending at a front side of sail housing 152 without reaching ends 154 and 156. Elongated aperture 158 allows sail 202 to deploy therefrom, as seen in FIG. 1. Channel 160 extends from end 154 at an upper side of sail housing 152. In a preferred embodiment, handle bar 162 is positioned at a rear side of sail housing 152.

Figure 3A:
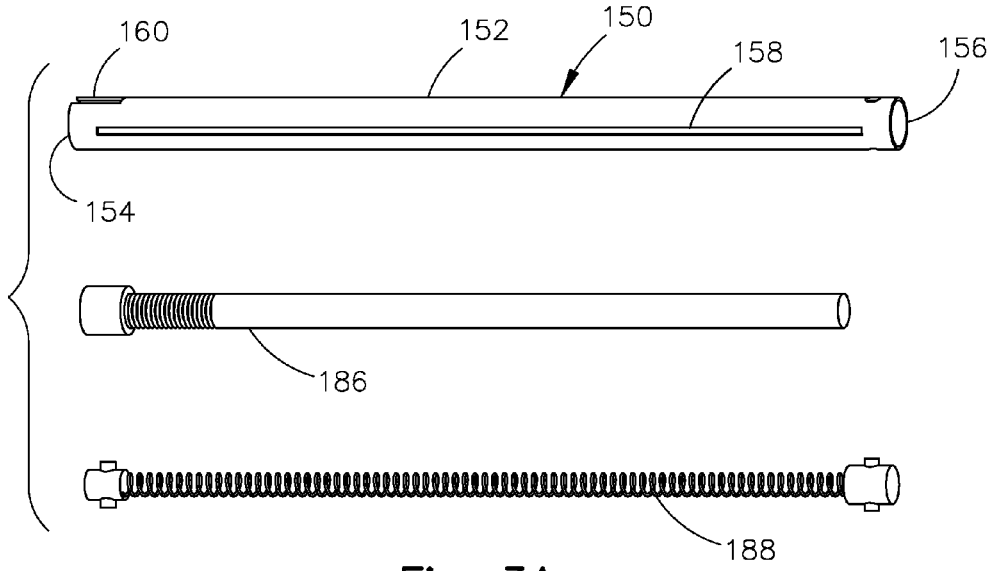
FIG. 3A is an exploded view, showing components of the handle bar and locking assemblies.
Figure 3B:
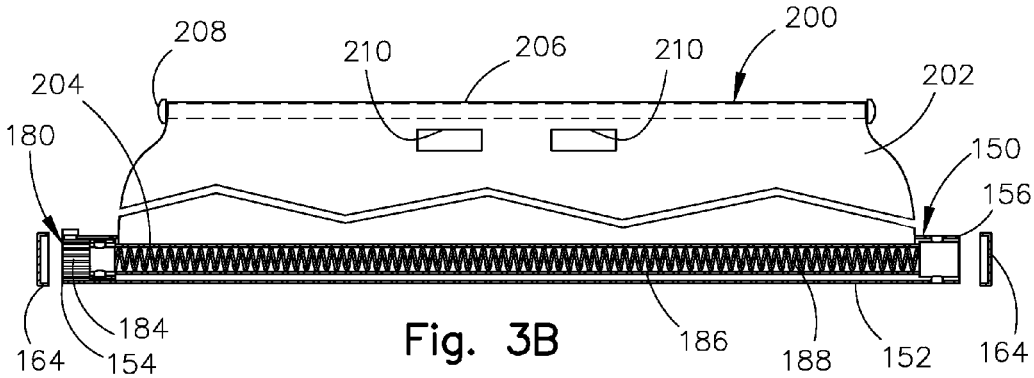
FIG. 3B is a cross-section view of the handle bar assembly, showing components of the locking assembly.
Figure 3C:
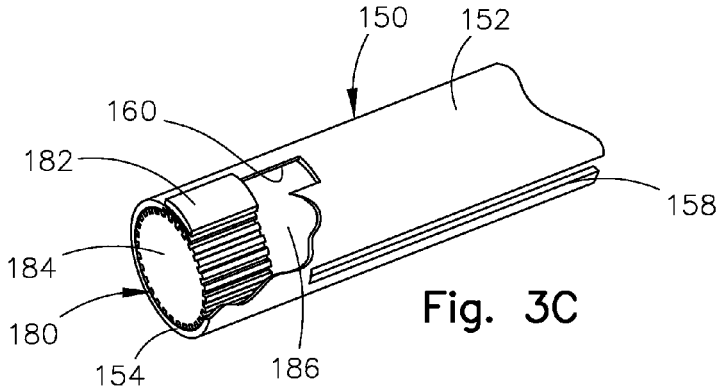
FIG. 3C is a partial cut view of the handle bar assembly, showing components of the locking assembly.

As seen in FIGS. 3A, 3B and 3C, handle bar assembly 150 comprises locking assembly 180 that is mounted within sail housing 152 having end caps 164. Locking assembly 180 comprises elongated shaft 186 having elongated internally-mounted spring 188 therein that is fixed at one end, the end opposite spool 184. Spring 188 and elongated shaft 186 are housed within sail housing 152. Spring 188, as a torsian spring, has a spring force to bias sail 202 to wrap around elongated shaft 186 and within sail housing 152. Locking assembly 180 further comprises locking tab 182 and spool 184 that engage elongated shaft 186. Specifically, elongated shaft 186 is locked when locking tab 186 is positioned over spool 184. To unlock elongated shaft 186, locking tab 182 is simply pushed away from spool 184 within channel 160.

Sail assembly 200 comprises sail 202 having a substantially rectangular shape, but slightly narrowing in size as it reaches distal edge 206, whereby sail 202 has proximal edge 204 and distal edge 206. Proximal edge 204 is fixed to elongated shaft 186. Distal edge 206 has elongated reinforcement 208 extending therethrough. Sail 202 also comprises through holes 210 that are shaped to receive C-clamps 134 when opened. To deploy sail 202, locking tab 182 is pushed away from spool 184 within channel 160. The user then pulls sail 202, preferably by elongated reinforcement 208, thereby overcoming the spring force of spring 188. It is noted that when desired the user may choose to deploy sufficient sail 202 material from sail housing 152 to receive wind forces, as seen in FIG. 1. The user then locks elongated shaft 186 by positioning locking tab 186 is positioned over spool 184. Pedal clamp assembly 130 is then pressed so that C-clamps 134 secure sail 202 through holes 210. Desirably, as seen in FIG. 1, the user positions instant invention 10 so that sail 202 catches the wind forces, causing the user, riding upon instant invention 10, to be propelled forward or generally in the direction of the wind forces.

Figure 4:
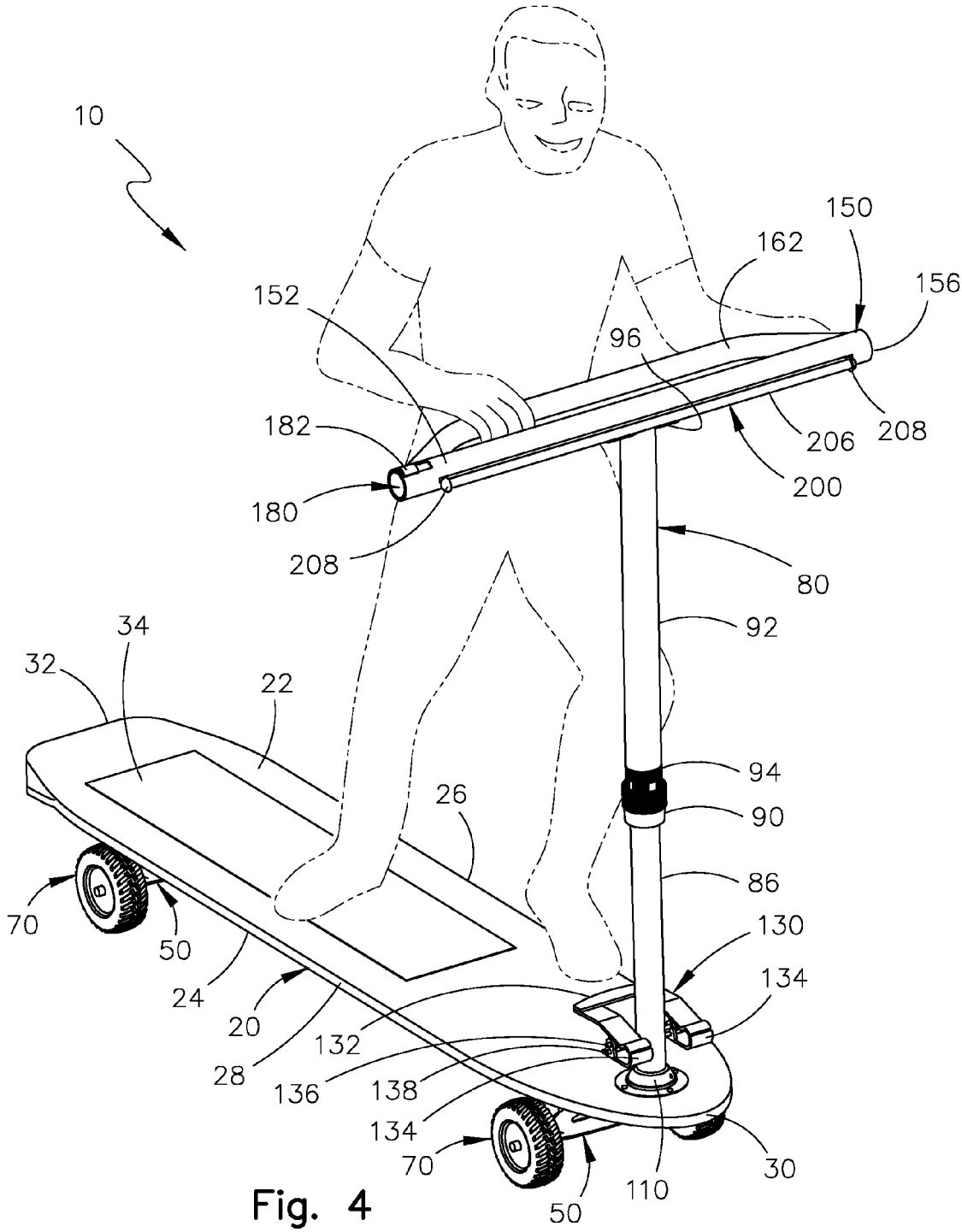
FIG. 4 is an isometric view of the present invention in use with its sail in a retracted configuration.

As best seen in FIG. 4, pedal clamp assembly 130 is mounted onto removable post assembly 80. Removable post assembly 80 comprises through holes 88 to receive hinge pin 136 and fixed pin 138 respectively to mount pedal clamp assembly 130. Specifically, pedal clamp assembly 130 is secured onto interior post 86 with hinge pin 136 and fixed pin 138. Hinge pin 136 also serves as a hinge for pedal 132. The user may place a force upon pedal 132 to open C-clamps 134, thus releasing sail 202 to use present invention 10 with sail 202 in a retracted configuration as seen in this illustration. Although not illustrated, it is noted that pedal clamp assembly 130 comprises an internal torsion spring to cause C-clamps 134 to remain in a closed position.

Figure 5:
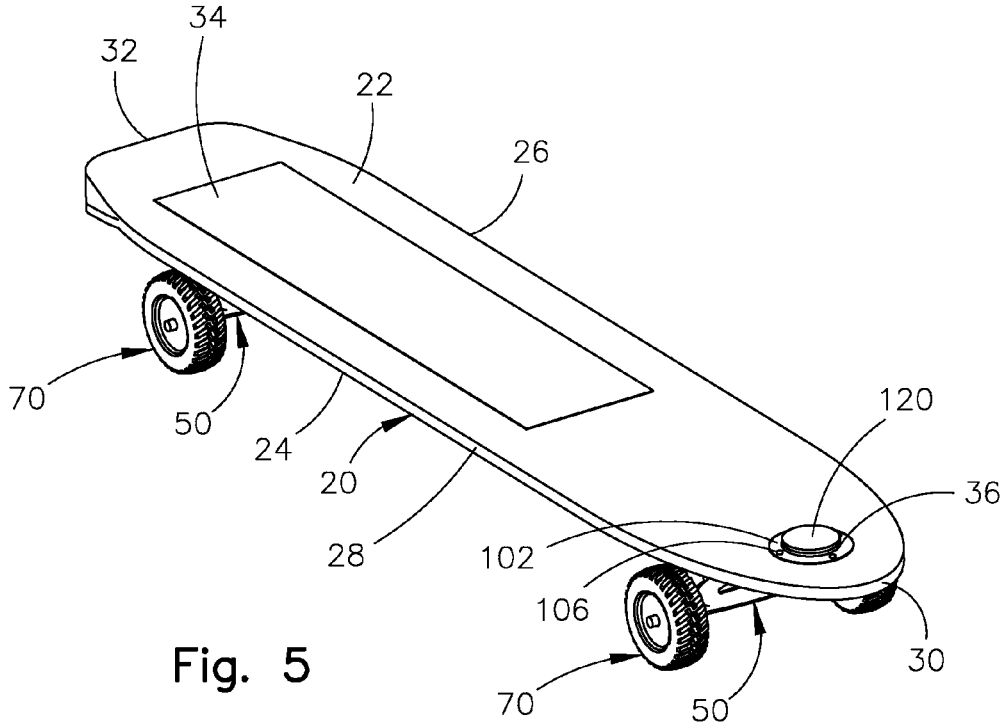
FIG. 5 is an isometric view of the present invention with the post assembly having been removed.

As seen in FIG. 5, the user may use present invention 10 without sail assembly 200 and removable post assembly 80. For this purpose, locking mount 110 is rotated to unlock coupling section 114 from coupling section 100, thus releasing removable post assembly 80. Then, the user may cover semi spherical housing 98 with cap 120.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A skateboard with sail assembly, comprising:

A) a skateboard having first and second ends and a through hole, said through hole positioned in between said first and second ends;

B) a removable post assembly, said removable post assembly projecting from said through hole;

C) a pedal clamp assembly mounted onto said removable post assembly, said pedal clamp assembly comprises a pedal and at least one C-clamp, said removable post assembly comprises through holes to receive a hinge pin and a fixed pin to mount said pedal clamp assembly, said hinge pin serves as a hinge for said pedal;

D) a handle bar assembly mounted onto said removable post assembly; and

E) a sail assembly comprising a sail, a force upon said pedal opens said at least one C-clamp, thus releasing said sail to a retracted configuration.

2. The skateboard with sail assembly set forth in claim 1, further characterized in that said removable post assembly comprises third and fourth ends, said third end defines a partial sphere.

3. The skateboard with sail assembly set forth in claim 1, further characterized in that said removable post assembly comprises an interior post, an exterior post, and a locking nut defining telescopic means to adjust height of said removable post assembly.

4. The skateboard with sail assembly set forth in claim 3, further characterized in that said exterior post has exterior threading for said locking nut to tighten onto.

5. The skateboard with sail assembly set forth in claim 2, further characterized in that said removable post assembly further comprises a semi-spherical housing to receive said partial sphere.

6. The skateboard with sail assembly set forth in claim 5, further characterized in that said removable post assembly further comprises a locking mount that locks upon said semi-spherical housing to secure said partial sphere.

7. The skateboard with sail assembly set forth in claim 5, further characterized in that said semi-spherical housing is self-lubricating.

8. The skateboard with sail assembly set forth in claim 5, further characterized in that said partial sphere freely moves and swivels within said semi-spherical housing when in an unlocked configuration.

9. The skateboard with sail assembly set forth in claim 6, further characterized in that said partial sphere and said locking mount each comprise a hole that receive a securing pin when aligned to place said partial sphere in a locked configuration to prevent it from freely moving and swiveling within said semi-spherical housing.

10. The skateboard with sail assembly set forth in claim 9, further characterized in that said handle bar assembly comprises a sail housing that houses said sail assembly.

11. The skateboard with sail assembly set forth in claim 10, further characterized in that said sail assembly comprises said sail having at least one through hole that engages with said at least one C-clamp when said sail is deployed.

12. The skateboard with sail assembly set forth in claim 11, further characterized in that said handle bar assembly further comprises a locking assembly.

13. The skateboard with sail assembly set forth in claim 12, further characterized in that said locking assembly comprises an elongated shaft having an elongated internally-mounted spring therein that is fixed at one end, said spring and said elongated shaft are housed within said sail housing.

14. The skateboard with sail assembly set forth in claim 13, further characterized in that said spring has a spring force to bias said sail to wrap around said elongated shaft and within said sail housing.

15. The skateboard with sail assembly set forth in claim 13, further characterized in that said locking assembly further comprises a locking tab and spool that engage said elongated shaft.

16. The skateboard with sail assembly set forth in claim 13, further characterized in that said sail has a proximal edge that extends from said elongated shaft.

17. The skateboard with sail assembly set forth in claim 11, further characterized in that said sail has a distal edge having an elongated reinforcement.

18. The skateboard with sail assembly set forth in claim 11, further characterized in that said sail housing comprises an elongated aperture to allow said sail to deploy from.

* * * * *